United States Patent [19]

Jarvis, Jr.

[11] Patent Number: 4,726,162

[45] Date of Patent: Feb. 23, 1988

[54] POLICE CAR SHIELD SYSTEM

[76] Inventor: Wilfred A. Jarvis, Jr., Rte. 3, Box 444, Glen Allen, Va. 23060

[21] Appl. No.: 932,036

[22] Filed: Nov. 18, 1986

[51] Int. Cl.[4] ..... E04H 1/12

[52] U.S. Cl. ..... 52/174; 52/745

[58] Field of Search ..... 52/174, 143, 64–69, 52/106, 741, 745; 109/9; 160/332; 350/601

[56] References Cited

U.S. PATENT DOCUMENTS

| | | | |
|---|---|---|---|
| 1,760,186 | 5/1930 | Barker | 52/69 |
| 2,282,324 | 5/1942 | Everitt | 52/65 |
| 3,108,820 | 10/1963 | Rich | 52/65 |
| 3,203,052 | 8/1965 | Curtis | 350/601 |
| 4,555,991 | 12/1985 | Bellezza | 52/106 |
| 4,607,678 | 8/1986 | Pomaville et al. | 160/332 |

FOREIGN PATENT DOCUMENTS

| | | | |
|---|---|---|---|
| 305988 | 3/1955 | Switzerland | 52/66 |

*Primary Examiner*—James L. Ridgill, Jr.
*Attorney, Agent, or Firm*—John F. C. Glenn

[57] ABSTRACT

Drivers are deterred from speed violations in absence of any police car by seeing a walled structure capable of containing and hiding a police car from outside view while permitting view from inside of traffic outside. At least one end wall permits rapid exit of a police car to make an arrest. The top is open to vent exhaust gas.

6 Claims, 3 Drawing Figures

POLICE CAR SHIELD SYSTEM

BACKGROUND OF THE INVENTION

Police cars with radar speed detectors can enforce highway speed limits where they are present, but the frequency of their presence at any one location is limited by considerations of cost. Their deterrent effect elsewhere largely depends on fear of drivers that when a police car is not in sight it may nevertheless be watching from a concealed position. However, citizen band radios are used by enough drivers to reduce this fear by broadcast of where traffic police cars are present and where they are not. Such broadcasts reduce the effectiveness of dummy police cars by the side of the road once a driver sees that no live officer is in the car and broadcasts the news.

SUMMARY OF THE INVENTION

In accordance with the present invention, the deterrent effect of the presence of a police car is preserved whether the car is actually present or not. This is accomplished by providing a highly visible shield within which a concealed police car can view the traffic, use its radar to detect any speed limit violations, and leave the shield immediately to arrest any violators. A single shield is effective over a long period as long as a police car uses it occasionally during the period. The invention further contemplates providing more shields than police cars using them, so that the police cars can go from shield to shield, always leaving some of the shields empty. The net result is a considerable saving of expense of enforcing speed laws, because one shield can be provided at substantially less cost than one police car with officer.

The shield of the invention is preferably a portable structure with verticle walls adapted to encircle a police car within, and one-way vision windows arranged to let the officer in the car see out for detection purposes while preventing the public from looking in to see whether a car and officer is in the structure. At least one end wall is arranged to permit rapid exit of a police car from within the structure for purposes of making an arrest.

Other objects, advantages and details of the invention will become apparent as the following description proceeds.

BRIEF DESCRIPTION OF THE DRAWING

The accompanying drawing schematically illustrates present preferred forms of apparatus practicing the invention, as follows.

DETAILED DESCRIPTION OF PRESENT PREFERRED EMBODIMENTS

Figure 1:
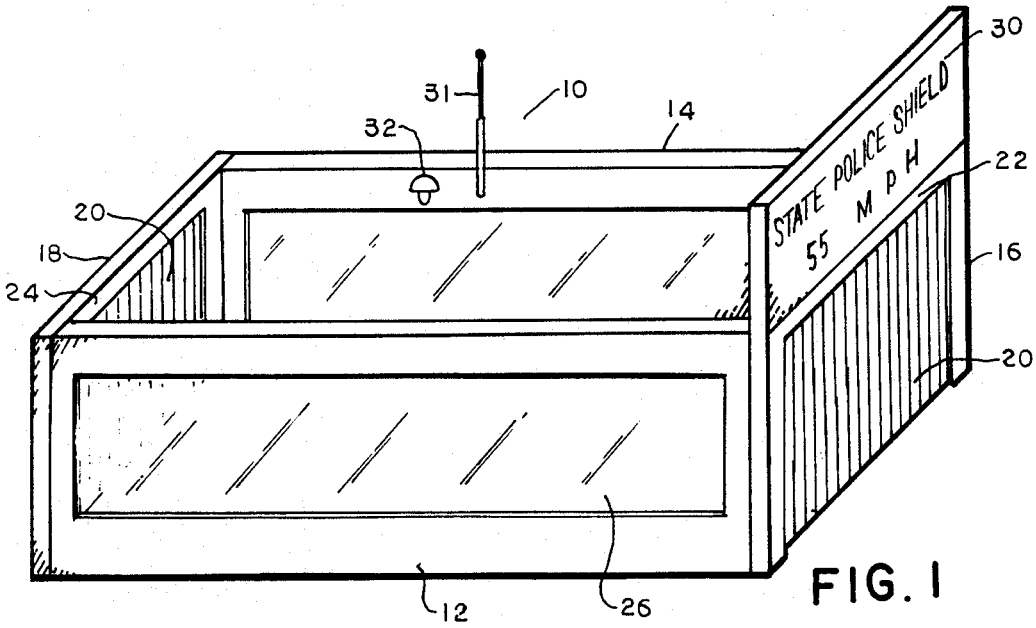
FIG. 1 shows an isometric view of a structure for shielding a police car.

Referring now more particularly to the accompanying drawing and initially to FIG. 1, there is shown a shielding structure 10 having a pair of side walls 12 and 14 adapted to receive a police car between them. The structure also has end walls 16 and 18 having large openings through which a police car can enter and exit by displacing opaque plastic strips 20 hanging vertically from cross beams 22 and 24 across the tops of the end wall opeinings. The side and end walls are all high enough to conceal a police car inside from view by the traffic outside.

Windows 26 and 28 in the side walls 12 and 14 have one-way vision properties, so that an officer in a police car inside can view the traffic outside and thereby determine when to use a radar detector to determine the speed of a probable speed violator. Conversely, these windows prevent the public in the traffic from seeing whether any car or officer is inside the structure.

A roof over the structure is omitted in order to thoroughly ventilate the structure and thereby releasing exhaust fumes of a police car in the structure before they can have any harmful effect on the officer in the car while its engine is running. A floor is likewise omitted since it is unnecessary and would merely add cost and weight. That leaves the four walls, which are made to be disconnected where they join each other, so that they can be placed together in compact side-by-side relation for convenient transportation to a changed location, and can readily be erected again at the new location.

The deterrent effect of the structure is enhanced by adding an extension 30 over the front end wall 16, with a suitable warning sign on its face, such as "State Police Shield—55 M.P.H.". The deterrent effect may be further enhanced by attaching a false antenna 31 and light source 32 within the structure, such as against the inside of the side wall 14.

Figure 2:
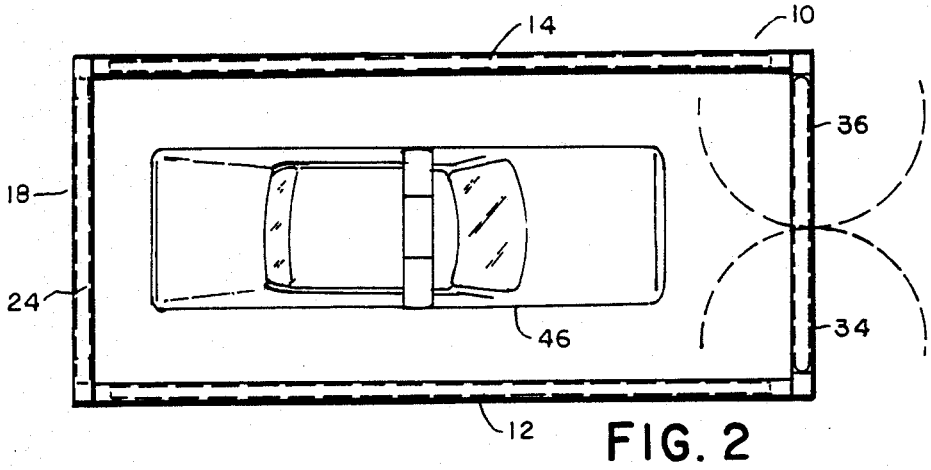
FIG. 2 shows a plan view of the structure shown in FIG. 1, except for substitution of swinging doors at the front end of the structure, and a police car in the structure.
Figure 3:
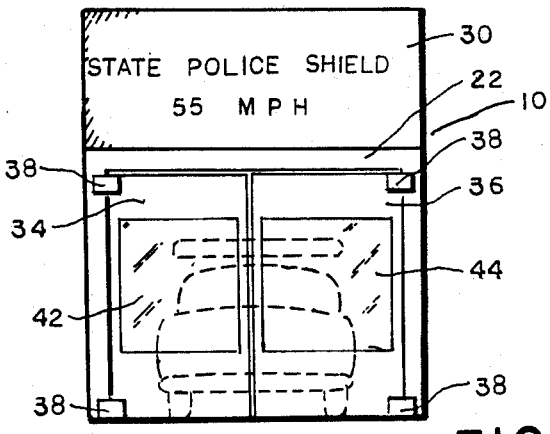
FIG. 3 shows a front end view of what is shown in FIG. 2.

The hanging strips 20 are suitable for all purposes except view from the police car inside. Accordingly, if view through the windows 26 and 28 is considered insufficient, the strips 20 across at least the front end wall 16 may be replaced by a pair of swinging doors 34 and 36 which are hinged along the opposite sides of wall 16, and are resiliantly biased to swing (See FIGS. 2 and 3) together along their outer vertical edges. The hinges 38 are preferably of the well known kind (such as used for restaurant kitchens) which permit swinging in both directions, with springs inside the hinge which return the door to its starting position in line with the other door. Windows 42 and 44 with one-way vision panes are installed in doors 34 and 36 to permit forward view from a police car 46 behind the doors while concealing the car from view from outside of the doors.

While present preferred embodiments and practices of the invention have been illustrated and described, it will be understood that the invention may be otherwise embodied and practiced within the scope of the following claims.

I claim:

1. A visible structure for concealing a traffic police car from outside view while permitting traffic observation from within the car, comprising walls adapted to be erected vertically around a police car for concealing it from outside view, and one-way vision windows in at least some of the walls for permitting a view of traffic outside from a car within the walls while substantially preventing a view from the outside which would reveal a car within the walls, at least one of said walls having means which readily yield to the pressure of a car and therby permit the car to exit from within the walls.

2. A structure according to claim 1, in which said yielding means comprises vertical plastic strips.

3. A structure according to claim 1, in which said yielding means comprises a pair of swinging doors, each of said swinging doors having a one-way vision window in it.

4. A structure according to claim 1, including a sign over the front of the structure identifying the structure as potentially harboring a traffic police car.

5. A structure according to claim 1, in which the structure is substantially entirely open at the top, whereby exhaust fumes from a police car in the structure are readily vented through the top.

6. A method of traffic speed control, comprising placing a conspicuous walled and open-topped structure where it can be seen from the road, providing one-way vision windows in the structure which permit seeing traffic on the road from within the structure while preventing those on the road from seeing what is within the structure, periodically hiding a police car in the structure, and marking the structure to indicate that a police car may be inside, whereby knowledge of those on the road that a police car may be in the structure will deter them from speed limit violations even when a police car is not in the structure.

* * * * *